United States Patent [19]

Confer

[11] Patent Number: 4,537,276

[45] Date of Patent: Aug. 27, 1985

[54] MASK/MICROPHONE SYSTEM FOR VOICE ACTUATED CONTROL

[75] Inventor: Richard G. Confer, Erie, Pa.

[73] Assignee: American Sterilizer Company, Erie, Pa.

[21] Appl. No.: 648,805

[22] Filed: Sep. 7, 1984

[51] Int. Cl.[3] ..... G10K 11/00

[52] U.S. Cl. ..... 181/21; 181/22

[58] Field of Search ..... 181/18, 21, 22; 128/200.27, 200.28, 200.29, 201.19, 209.27

[56] References Cited

U.S. PATENT DOCUMENTS

| | | | |
|---|---|---|---|
| 2,376,871 | 5/1948 | Fink | 128/201.19 |
| 3,467,091 | 9/1969 | Aragona | 128/201.11 |
| 4,473,130 | 9/1984 | Korber et al. | 181/22 X |

FOREIGN PATENT DOCUMENTS

| | | | |
|---|---|---|---|
| 828843 | 5/1938 | France | 128/201.19 |
| 42409 | 1/1908 | Switzerland | 128/201.19 |

*Primary Examiner*—Benjamin R. Fuller

*Attorney, Agent, or Firm*—Robert D. Yeager; Andrew J. Cornelius; Christine R. Ethridge

[57] ABSTRACT

A device for transmitting sound from a speaker in a first area, such as a sterile or clean field, to a second area such as a nonsterile or nonclean field. The device includes a sound conduit having an inlet and an outlet and being of sufficient length to permit placement of the inlet in the first area and placement of the outlet in the second area, means, such as a filter mask, for securing the inlet in an operative position relative to the speaker's mouth, and a coupler connected to the outlet. A microphone and means for adjusting the sound pressure transmitted through the conduit are preferably also provided.

7 Claims, 3 Drawing Figures

MASK/MICROPHONE SYSTEM FOR VOICE ACTUATED CONTROL

BACKGROUND OF THE INVENTION

1. Field of the Invention

The present invention relates to systems for sound transmission, and more particularly to a device for transmitting sound from a speaker in a first area to a second area.

2. Description of the Prior Art

A surgeon operating in a sterile field, or an electronics technician operating in a clean field, in which it is imperative that particulates and microorganisms be kept at minimum levels, may be required to control various pieces of equipment. Touching the equipment increases the risk of contamination of the sterile or clean fields. Voice actuated controls would eliminate the need for touching the equipment.

However, voice actuated controls in specialized environments present problems. Specifically, the placement of the microphone is important, both to the accuracy of voice control and to the maintenance of the sterile or clean field. In addition, the comfort of the surgeon or technician must be considered. A microphone placed near the mouth would enhance accuracy but would interfere with the speaker's mask. Furthermore, the microphone would then be in the sterile or clean field, and thus would have to be sterilized between uses or discarded.

There is a need therefore, for a device which will accurately transmit sound from the speaker in the sterile or clean field to an area outside of that field. Such a device should permit the placement of the microphone outside of the sterile or clean field to eliminate the need to sterilize or discard the microphone after each use. There is a further need for a device which can either be repeatedly sterilized between uses or discarded and inexpensively replaced. The device should provide for repeatability in placement of the microphone. Finally, the device should not interfere with the speaker's mask.

SUMMARY OF THE INVENTION

The present invention provides a device for transmitting sound from a speaker's voice in a first area, such as a sterile field or a clean field, to a second area, outside of the sterile or clean field. The device includes a sound conduit having an inlet and an outlet and being of a length sufficient to permit placement of the inlet in the first area and placement of the outlet in the second area, means for securing the inlet in an operative position relative to the speaker's mouth, and a coupler connected to the outlet.

A microphone is preferably acoustically coupled to the outlet by the coupler to receive the sound transmitted through the conduit. Means for adjusting the sound pressure transmitted through the conduit may also be provided. Preferably, the coupler is a hollow tube having a plurality of holes therein which, when covered, increase the sound pressure applied to the microphone. The holes provide the adjusting means. Increased sound pressure increases the effective signal output of the microphone.

The microphone and the coupler are positioned for placement in the second area.

The securing means may be a mechanical filter, or a surgical mask, for filtering particulates and microorganisms. The filter is structured for placement over the speaker's mouth. The inlet is connected to the filter. It may be so connected that the inlet is positioned to one side of the speaker's mouth when the filter or mask is worn.

The conduit is preferably a hollow hose. Means for relieving air pressure within the hose, such as a hole positioned for placement in the second area, may also be provided.

BRIEF DESCRIPTION OF THE DRAWINGS

The following detailed description of the preferred embodiment can better be understood if reference is made to the drawings in which.

DETAILED DESCRIPTION OF THE PREFERRED EMBODIMENT

Figure 1:
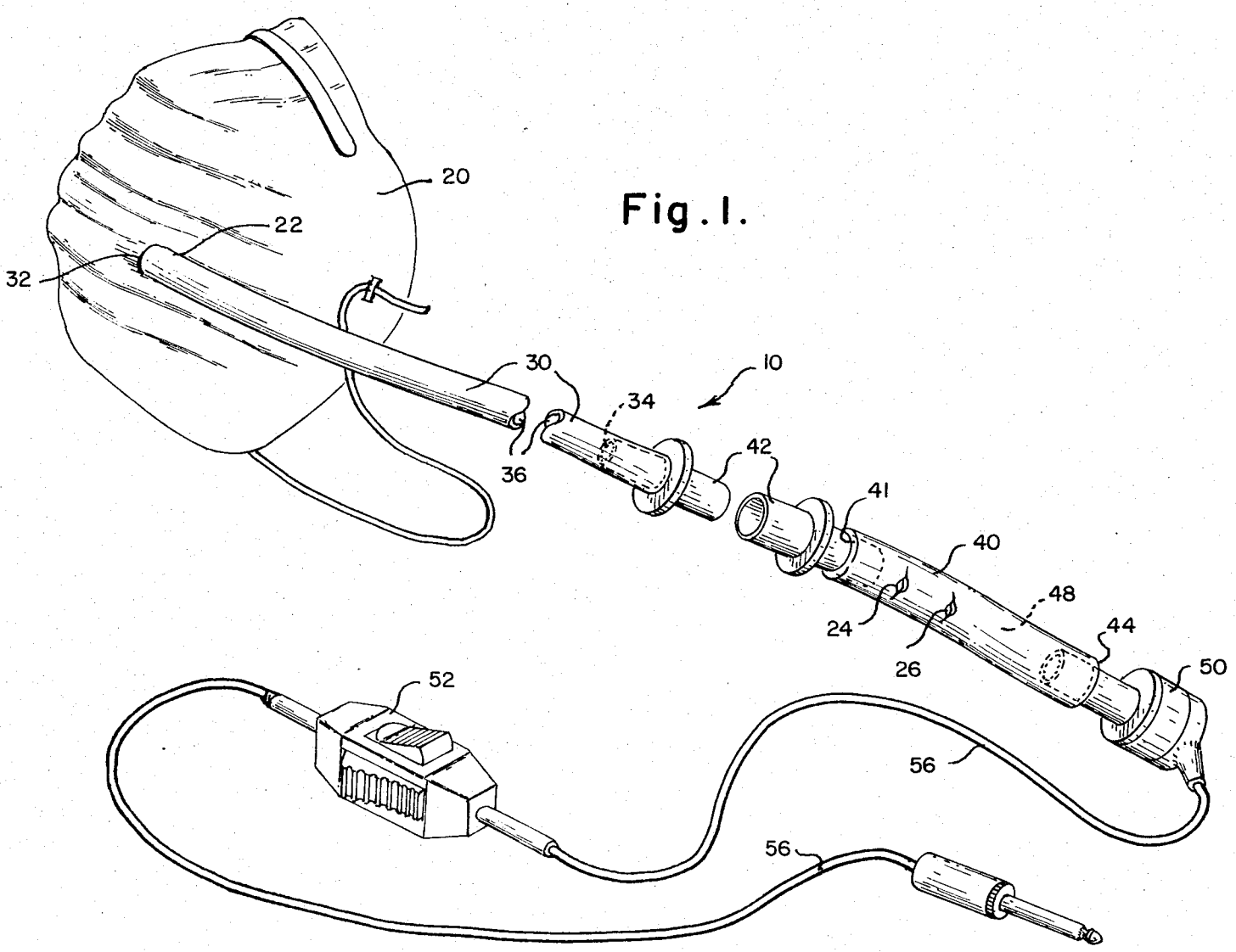
FIG. 1 is a perspective view of the Mask/Microphone System of the present invention showing cutaway portions.
Figure 3:
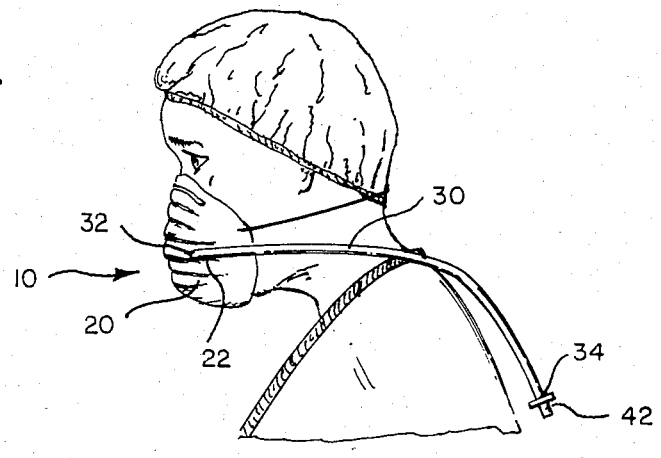
FIG. 3 is a side view of the speaker wearing the mask.
Figure 2:
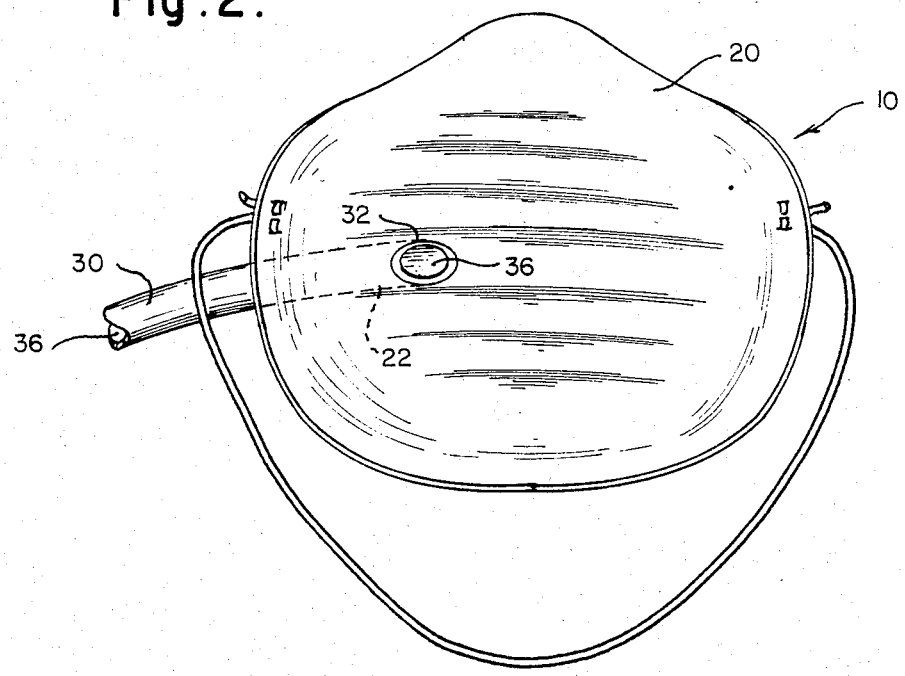
FIG. 2 is a view of the interior of the mask of FIG. 1.

FIGS. 1 through 3 illustrate the preferred embodiment of the device 10, a mask and microphone system for voice actuated control, of the present invention.

The device 10 includes a semirigid mask 20, a flexible hollow hose 30 which provides a sound conduit, a coupler 40, and microphone 50. The hose 30 has inlet 32 and outlet 34. Hollow 36 of hose 30 extends from the inlet 32 to the outlet 34. Inlet 32 is connected, either releasably or fixedly, to the side 22 of mask 20.

The coupler 40 is connected to outlet 34, preferably by means of a male/female plug 42. However, any suitable known means of airtight, releasable connection will suffice. Alternatively, the coupler 40 may be fixedly connected to outlet 34 provided coupler 40 may be released from microphone 50. In the preferred embodiment, shown in FIG. 1, coupler 40 is releasably connected at both ends, 41 and 44, to the outlet 34 and microphone 50, respectively.

Coupler 40 is a hollow tube having bore 48 and a plurality of holes 24 (only one shown) and one hole 26 therein. Holes 24 provide the means for adjusting the sound pressure transmitted through the hose 30 and applied to the microphone 50. Covering holes 24 increases the sound pressure applied to the microphone 50. Hole 26 provides the means for relieving any excess air pressure within the hose 30. Hole 26 is provided when the microphone 50 is a noise cancelling microphone. Hole 26 is not needed when other types of microphones are used.

Microphone 50 is any suitable known microphone. It may include an on/off control switch 52 and itself is electrically connected, by means of wire 56, to apparatus (not shown) for voice recognition and processing to facilitate the voice actuated control of equipment.

The system can be used to control, for example, lighting, microscope function, cameras and related equipment used in a surgical suite. In other applications of the present invention, the system can be programmed to control the manufacture of particulate sensitive electronic equipment, or to permit the speaker to record data while working.

The inlet 32 is securely held due to the rigidity of the mask 20. Alternatively, separate means (not shown) may be provided to secure inlet 32 to side 22 of mask 20. The position of inlet 32 at the side 22 of mask 20 keeps it at an optimum position relative to the speaker's mouth to accurately transmit sound through hose 30.

Mask 20 may be any suitable known surgical mask or a mechanical filter which filters particulates and/or microorganisms. The mask 20 should be structured to permit placement over the speaker's mouth.

Hose 30 is preferably made of a flexible plastic which will permit the hose 30 to be positioned as desired. The hose 30 should be sufficiently long to permit inlet 32 to be positioned in mask 20 in a first area, such as a sterile field or a clean field, and outlet 34 to be positioned in a second area, outside of the first area.

The outlet 34, coupler 40 and microphone 50 should always be placed in the second area when maintenance of a sterile or a clean field is important. The length of hose 30, therefore, depends upon the particular application and environment. However, the length of hose 30 should be consistent for each application, and for each user to enhance the performance of the device 10 and the comfort of the user. Also, by fixing the length of tubes 30 and coupler 40, the acoustic path length is fixed and consistent. Therefore, repeatable results can be expected because microphone placement is not subject to error in placement.

The mask 20 and hose 30 should either be sterilized between uses, or discarded after each use. Preferably, the entire assembly can be discarded after one use. Sterile replacements should be provided for the discarded items. The microphone 50 and the coupler 40 need not be sterilized or discarded because it should always be positioned outside of the first area.

In use, the speaker voices a command which is transmitted through inlet 32, hollow 36, outlet 34, coupler 40 and into microphone 50. Holes 24 should be adjusted to apply the optimum level of sound pressure to the microphone 50. The position of inlet 32 to the side of the speaker's mouth prevents a buildup of air pressure in the hose 30. Should there be such a buildup, however, hole 26 is provided to relieve the excess air pressure in hose 30 which is desirable when noise cancelling microphones are used.

The remote mounting of microphone 50 provided by the device 10 of the present invention, permits the accurate transmission of voice commands from the speaker in a sterile or clean field to an area outside of that field, without interfering with the speaker's mask and, more importantly, without requiring sterilization of the microphone.

What is claimed is:

1. A device for use with a microphone for transmitting sound from a speaker in a first area to a second area outside of the first area, comprising:

a sound conduit having an inlet and an outlet of a length sufficient to permit placement of said inlet in the first area and placement of said outlet in the second area;

means for securing said inlet in an operative position relative to the speaker's mouth; and a coupler connected to said outlet for acoustically coupling said microphone to said outlet, said coupler forming a hollow tube and having a plurality of holes in said tube for adjusting the sound pressure transmitted through said conduit to said microphone, said holes, when covered, increasing the sound pressure in said tube.

2. A device as recited in claim 1 wherein said securing means is a mechanical filter for filtering particulates and microorganisms, said filter being structured for placement over the speaker's mouth, and said inlet being connected to said filter.

3. A device as recited in claim 1 wherein said securing means is a surgical mask, said inlet being so connected to said mask that said inlet is positioned to one side of the speaker's mouth when said mask is worn.

4. A device as recited in claim 1 wherein the first area is a sterile field and the second area is outside of the sterile field.

5. A device as recited in claim 1 wherein the first area is a clean field and the second area is outside of the clean field.

6. A device as recited in claim 1 wherein said conduit is a hollow hose.

7. A device as recited in claim 6 further comprising means for relieving air pressure within said hose, said relieving means being positioned for placement in the second area.

* * * * *